US007123733B1

(12) United States Patent
Borowsky et al.

(10) Patent No.: US 7,123,733 B1
(45) Date of Patent: Oct. 17, 2006

(54) AUDITORY TREATMENT DEVICE

(75) Inventors: Hans-Dieter Borowsky, Neuenkirchen (DE); Roman Jandaurek, Rheine (DE); Theo Wesendahl, Rheine (DE); Edmund Löbbers, Neuenkirchen (DE)

(73) Assignee: Auric Horsysteme GmbH & Co. KG, Rheine (DE)

( * ) Notice: Subject to any disclaimer, the term of this patent is extended or adjusted under 35 U.S.C. 154(b) by 0 days.

(21) Appl. No.: 09/890,227

(22) PCT Filed: Jan. 21, 2000

(86) PCT No.: PCT/DE00/00191
§ 371 (c)(1),
(2), (4) Date: Nov. 14, 2001

(87) PCT Pub. No.: WO00/45617

PCT Pub. Date: Aug. 3, 2000

(30) Foreign Application Priority Data

Jan. 27, 1999 (DE) ..... 199 03 090
Jun. 14, 1999 (DE) ..... 299 10 318 U

(51) Int. Cl.
*H04R 25/00* (2006.01)

(52) U.S. Cl. ..... 381/322; 381/323; 381/330

(58) Field of Classification Search ..... 381/312, 381/322, 328, 330, FOR. 127, 314, 323, 381/324, 338, 381, 382; 361/816, 818; 174/35 R, 174/35 TS, 35 MS; 455/300; 429/96, 97, 429/98, 100; 181/128, 129, 816, 818
See application file for complete search history.

(56) References Cited

U.S. PATENT DOCUMENTS

| | | | | |
|---|---|---|---|---|
| 5,640,457 | A * | 6/1997 | Gnecco et al. | 381/322 |
| 5,675,657 | A * | 10/1997 | Giannetti | 381/312 |
| 5,708,720 | A | 1/1998 | Meyer | 381/69 |
| 5,724,431 | A * | 3/1998 | Reiter et al. | 381/323 |
| 6,041,128 | A * | 3/2000 | Narisawa et al. | 381/322 |
| 6,144,750 | A * | 11/2000 | Levin | 381/328 |
| 6,574,343 | B1 * | 6/2003 | Meier | 381/322 |

FOREIGN PATENT DOCUMENTS

| | | |
|---|---|---|
| DE | 196 35 229 A1 | 3/1998 |
| DE | 197 18 223 A1 | 11/1998 |
| EP | 0 684 749 A2 | 11/1995 |
| GB | 2 124 495 A | 2/1984 |
| WO | WO 95/22879 | 8/1995 |

* cited by examiner

*Primary Examiner*—Huyen Le
(74) *Attorney, Agent, or Firm*—Lahive & Cockfield, LLP

(57) ABSTRACT

The invention relates to a hearing aid for correcting hearing impairments, comprising a metal housing which has a battery compartment and a sound exit opening. According to the invention, the housing surrounds the electronics located in the treatment device in such a way as to shield them from electromagnetic waves on all sides and the sound exit opening is sealed by an acoustically permeable, water-tight film. The housing also has an essentially cylindrical shape.

6 Claims, 1 Drawing Sheet

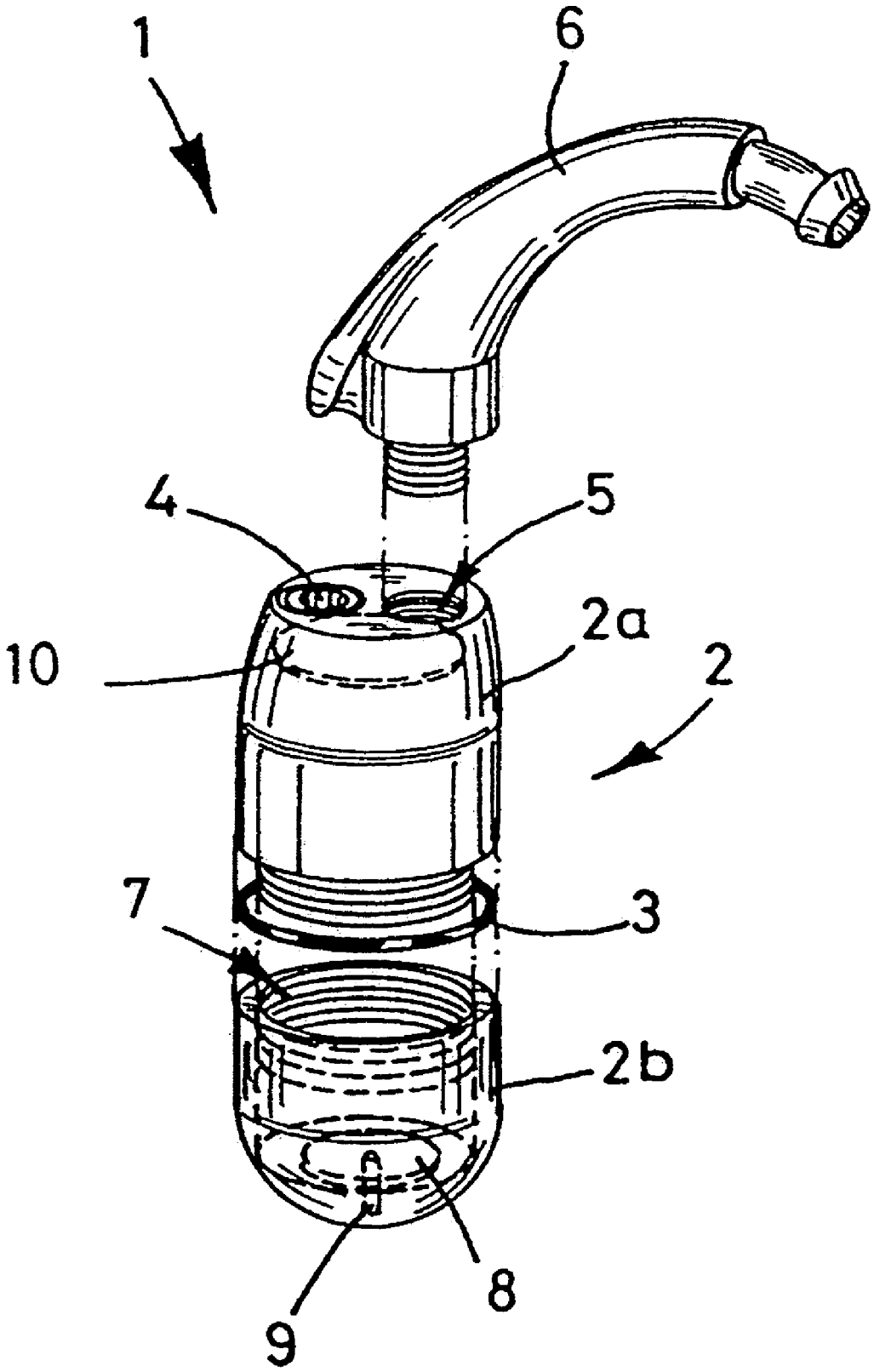
1
6
4
5
2a
10
2
7
3
2b
8
9

AUDITORY TREATMENT DEVICE

RELATED APPLICATIONS

This application claims priority to PCT International Patent Application No. PCT/DE00/00191, filed Jan. 21, 2000, German Patent Application No. DE 199 03 090.1, filed Jan. 27, 1999, and German Patent Application No. DE 299 10 318.8, filed Jun. 14, 1999 in Germany. This international patent application was published in German. The contents of the aforementioned applications are hereby incorporated by reference.

BACKGROUND OF THE INVENTION

The invention relates to an auditory treatment device for correcting hearing impairments.

German patent DE 38 40 393 C3 discloses such a treatment device which is worn in the ear. It has a pear-shaped or mushroom-shaped contour and contacts the auditory canal and external ear. The term "housing" is used to designate only the part contacting the skin of the wearer, which part actually belongs to a two-part housing, the outwardly visible front of the device being designed in the familiar fashion as a "cover plate" or "face plate" on which the entire electronics unit of the treatment device is located. These cover plates are composed of plastic which is normally designed to match the visual color of the ear since this cover plate is visible when the user wears it, whereas the metallic housing component extending into the ear is not visible.

The so-called "housing" is thus positioned simply like a hood on this cover plate and may be individually form-fitted to the individual patient. This "housing" may in fact be fabricated of metal to form an electrode which, interacting with a second electrode, forms an automatic on/off switch which automatically switches the device on when it is inserted into the ear and which also reduces the resistance between the electrodes due to skin moisture.

Due to the growing use of small, electronic devices used adjacent to the head, such as cellular or cordless telephones, generic treatment devices are often exposed to radiated noise, or may themselves generate radiated noise which interferes with such devices.

Due to the ever-smaller dimensions achievable for the electronics unit, and thus for the entire treatment devices for which miniaturization is desirable for cosmetic reasons, there exists the added risk of unintended damage to the treatment device when it is inadvertently ignored, or for example, loosens from or falls out of the wearer's ear during exercise.

SUMMARY OF THE INVENTION

The object of the invention is thus to improve a generic treatment device such that it permits the wearer to pursue the most active lifestyle possible while remaining as insusceptible as possible to mechanical and electronic disturbances.

The invention proposes, in other words, fabricating the housing of the treatment device completely, rather than partially, from metal so that the electronics unit of the treatment device is shielded on all sides. This approach ensures on the one hand that external interfering pulses do not disturb the hearing aid, and secondly, that any pulses emanating from the hearing aid are suppressed and cannot disturb external devices.

Additionally, the metallic housing creates excellent mechanical strength which considerably exceeds the strength exhibited by treatment devices that are normally made of plastic. Tests have demonstrated that a person can stand on such a metal treatment device and that it may be run over by a truck, yet remain completely functional.

This mechanical strength essentially results from the basic cylindrical shape of the housing, although barrel-shaped or slightly banana-shaped-and-bent longitudinal contours or polygonal cross-sectional contours are also possible and are subsumed under the term "essentially cylindrical" of the present invention.

In addition to this fundamental mechanical and electrical strength of the hearing aid, a special feature protecting against fluids may be added. The term "fluids" according to the invention here does not cover all possible fluids, for example aggressive acids or the like, but such fluids as would normally be found around the house or during leisure activities and to which the treatment device would normally be exposed, such as perspiration or personal hygiene products, as well as water, possibly mixed with detergents. The terms "water" or "watertight" are always used hereinbelow merely as examples of these previously known fluids.

To meet this requirement, the battery compartment may be designed to be watertight relative to the rest of the housing, a number of well-known approaches being available to an individual skilled in the art: A watertight clip feature securing the battery-compartment lid to the rest of the housing may be used, or a circumferential elastomer seal on the battery compartment or lid of the battery compartment may be provided, or a watertight seal of the battery compartment or battery-compartment lid may be achieved by a labyrinthine contour.

In connection with this watertight feature, it is additionally advantageous to provide a watertight seal for the sound exit opening. For this purpose, the invention provides a film which is acoustically transmitting yet still watertight so that this film provides the last barrier to any incoming water which might otherwise penetrate the interior of the treatment device and cause damage. A suitable film, for example, might be one made of a stretched plastic such as that known under the trade name "Gore-Tex."

Devices according to the invention may, for example, be designed as a tinnitus masker having only one sound exit opening for transmitting the treatment sounds. However, it is also advantageous to provide, in addition to the sound outlet opening, a sound receiving opening which also has a watertight seal using a film as described above. It is the sound receiving opening which transforms the treatment device into a hearing aid which transmits the received sounds in amplified form. If needed, two separate films may be employed at the two openings.

In the event the housing has two openings and both openings have a watertight seal, an advantageous approach, both in terms of cost and assembly, is to use one single piece of film. An acoustic separation of the films at both openings may be provided so as to preclude any effect from noise emitted at the sound exit opening due to sound events picked up at the sound receiving opening. The sections of a single film associated with the two openings can be separated acoustically from one another by having at least one of these sections delimited by a frame which prevents the transmission of vibrations from one section to the other. For example, the frame may be formed by a ring surrounding one of the sections, or it may surround both sections in an octagonal shape, or it may be formed by a component which adjoins the film and which has one opening in the area of each film section.

The housing may advantageously have two components, one containing the battery compartment and the other accommodating the actual electronics unit of the treatment device. Both components may be screwed together such that to open the battery compartment, in place of a hinge arrangement, one simply unscrews the component of the housing containing the battery from the other component.

The thread has a circular cross-section and facilitates simple and reliable sealing of the battery compartment through the use of commercially available and inexpensive O-rings. In addition, this arrangement permits the treatment device to be easily switched on and off by unscrewing the component containing the battery compartment from the other component of the treatment device—thereby avoiding the need for any externally operated on/off switch which would be movable and would require a watertight seal. The invention thus facilitates a reliable watertight seal and inexpensive fabrication of the treatment device.

This two-part design of the housing, the arrangement of the thread and O-ring seal, and the manipulation of this type of treatment device, especially the screw movement, are all facilitated by the essentially cylindrical shape of the housing.

An additional advantageous feature may be provided in which no movable external operating elements at all are provided in the treatment device, for example, rotatable potentiometers, toggle switches, or pushbuttons. This approach facilitates sealing the treatment device, thereby enhancing the reliability of the treatment device and reducing its production costs.

The housing may advantageously be composed of titanium or a titanium alloy: This feature provides an allergen-free or low-allergen housing which additionally exhibits high mechanical strength and resistance to chemicals, and due to its low weight provides a high level of wearing comfort, which additionally guarantees reliable electrical shielding of the electronics unit, and which may have a variety of designs based on appropriate surface treatment, for example, anodizing, and is thus easily tailorable to the wishes of the customer in terms of the visual appearance of the treatment device.

Retaining means may advantageously be provided which fix the battery in its position inside the battery compartment. Such retaining means allow for the elimination of a separate on/off switch: With the battery retained in the battery compartment, appropriate movement of the battery compartment relative to the rest of the housing can enable the device to turn on or off through said movement, since contact between the battery and the actual electronics unit of the treatment device may be made or broken by such movement.

In order to ensure that the use of such retaining means permits the battery to be safely removed from the battery compartment, despite the limitations of fine-motor skills, a drilled hole of small diameter may advantageously be provided in the battery compartment. When the battery needs to be replaced, a type of pin may, for example, be inserted through this hole into the battery compartment to loosen the battery from its holder.

These retaining means may be simply and advantageously designed as a magnet. This approach ensures sufficient retaining force, on the one hand, and easy removability of the battery on the other. Unlike the use of mechanical retaining means, for example clips or the like, this feature precludes a situation in which, due to wear on such retaining means, the secure retention of the battery can no longer be ensured as the service life of the treatment device increases.

The magnet may advantageously be designed as a ring magnet, either as one piece or composed of multiple components, in which the recess of this ring magnet is located over the aforementioned small hole of the battery compartment so as to allow easy ejection of the battery in the manner described.

The proposed auditory treatment device may, for example, be designed as an in-ear or behind-the-ear device. Appropriately shaped sound tubes which transmit the sound from the sound exit opening of the housing to the vicinity of the eardrum of the user may be removably connected to the housing, for example, by means of a thread. The sound tubes may thus be removed if damaged or for cleaning. Additionally, given sufficiently small dimensions, the same housing may selectively be worn in the ear or behind the ear based on the use of an appropriate sound tube.

BRIEF DESCRIPTION OF THE DRAWINGS

An embodiment of the invention is described in detail based on the drawing.

DESCRIPTION OF ILLUSTRATED EMBODIMENT

Reference 1 indicates a general treatment device which has a two-part housing 2 made of a titanium alloy. The upper housing component 2*a* contains the electronics unit of the treatment device, while component 2*b* shown at the bottom contains a battery compartment 7 of treatment device 1. The two components 2*a* and 2*b* are screwed together, an O-ring 3 located in the screw section allowing for the design of completely watertight housing 2.

Treatment device 1 is designed as a hearing aid. It has a sound receiving opening 4 behind which a microphone is located. Sound receiving opening 4 is sealed off by a watertight yet acoustically transmitting film. Additionally, housing component 2*a* has a sound exit opening 5 through which sounds are transmitted to the ear of the patient or wearer of the treatment device. These sounds are transmitted from the sound exit opening through a sound tube 6 into the ear of the wearer of treatment device 1.

Sound tube 6 connects in a watertight fashion to housing component 2*a* and is, in other words, open only in the area of its front free end, thus often preventing the penetration of fluid. In addition, however, sound exit opening 5 is also sealed by a watertight yet acoustically transmitting film, thus preventing the penetration of moisture into housing component 2*a* in this case as well. The electronics unit located in housing component 2*a* is also accommodated in a watertight fashion in housing component 2*a*, for example, glued in a watertight fashion, thus forming a water barrier to battery compartment 7.

These electronics units may have contacts on their bottom side facing the interior of housing component 2*b*, thus permitting the aforementioned contacts to connect to a battery located in battery compartment 7. These or other contacts may also serve as a connecting feature for external programming devices such that, with housing component 2*b* removed, the electronics unit of treatment device 1 may be modified, for example programmed, and adjusted to the hearing level of the patient.

Located within battery compartment 7 is a ring magnet 8 which holds the battery located in battery compartment 7 in its prescribed position. When housing component 2*b* is unscrewed from housing component 2*a*, this ring magnet 8 ensures that the battery is removed from the contacts of the electronics unit of the treatment device 1, thereby automatically switching off the treatment device without having to actuate a separate switch provided for this purpose. Using ring magnet 8, it is possible to switch off treatment device 1 by a slight rotary movement, thereby sparing O-ring 3 and precluding hazards from affecting O-ring 3 since housing component 2*b* need not be completely unscrewed each time from housing component 2*a* in order to switch the device off.

In housing component 2*b*, there is provided a lower hole 9 of small diameter which exits into the central opening of ring magnet 8. When a small-diameter tool is inserted into hole 9, this tool, for example a pin, may be used to loosen the battery from ring magnet 8 and remove it from battery compartment 7.

Hole 9 additionally permits air to enter the battery compartment, thereby ensuring problem-free operation when, for example, zinc-air batteries are employed. Due to the small diameter of hole 9, and the arrangement of the battery and ring magnet 8, which together form a type of labyrinth seal, the interior of housing component 2*b* remains water-tight for the common practical uses of an auditory treatment device, despite the presence of hole 9, especially since lower housing component 2*b* connects in a water-tight and air-tight fashion to upper housing component 2*a*, with the result that lower housing component 2*b* has its hole 9 simply as a one-sided opening such that, lacking a second venting hole and due to the small diameter of hole 9, any displacement of the air contained in battery compartment 7 and resulting penetration of moisture is impeded.

In the event there are more stringent requirements in terms of impermeability for the treatment device, as a variation from the embodiment presented, a water barrier may be provided between the magnet and the battery, for example, in the form of a film bag inserted into housing component 2*b*. The small thickness of the material ensures that the holding force of the magnet is sufficient. The bag shape allows the film material to deform considerably, thus enabling the battery to be ejected by using hole 9. By using an air-permeable film material, any type of battery may be used without problems.

Reference 10 indicates a film which is both watertight and acoustically transmitting due to extremely small pores. Based on the small dimensions of treatment device 1, a single piece of film is provided to facilitate assembly. In order to prevent the vibrations of this film 10 from mutually impairing both the pickup and exit of sound, both of the film sections at these openings are acoustically separated, for example, by a frame which separates at least one of the two sections from the other section. This type of frame may be formed either by the upper side of the unit containing the electronics unit or a separate component.

The dimensions of treatment device (1) may be kept comparatively small. For example, given a diameter of about 1 cm and an overall length of about 2 cm, it may be worn, for example, either as a retroauricular treatment device behind the ear, or also in the ear.

The surface design of housing 2 may be matte, corrugated or noncircular so as to facilitate a secure grasp when the two housing components 2*a* and 2*b* are screwed together or unscrewed.

The invention claimed is:

1. A treatment device for correcting impairments to hearing, comprising:

an essentially cylindrically shaped housing, free of externally accessible elements that require movement for operation, and formed of metal, the housing having a battery compartment and a sound exit opening;

wherein the housing completely surrounds and shields an electronics unit located therein against electromagnetic waves; and wherein the battery compartment includes a ring magnet retaining means for retaining batteries in the battery compartment and a hole providing external access to the battery compartment, the hole exiting into a center recess of the ring magnet retaining means.

2. The treatment device according to claim 1, wherein the battery compartment comprises a watertight seal from the rest of the housing.

3. The treatment device according to claim 1, wherein the sound exit opening is sealed by an acoustically transmitting, watertight film.

4. The treatment device according to claim 2, wherein the sound exit opening is sealed by an acoustically transmitting, watertight film.

5. The treatment device according to claim 1, wherein the housing comprises a first housing component with the battery compartment being fastened together with a second housing component and an O-ring seal (3) being located therebetween.

6. The treatment device according to claim 1, wherein the housing is composed of titanium or a titanium alloy.

* * * * *